US009290903B2

(12) United States Patent
Hebestreit et al.

(10) Patent No.: US 9,290,903 B2
(45) Date of Patent: Mar. 22, 2016

(54) SUPPORT FOR OFFSHORE FOUNDATION STRUCTURES, PARTICULARLY TRIPODS

(71) Applicant: BLG Logistics Solutions GmbH & Co. KG, Bremen (DE)

(72) Inventors: Thorsten Hebestreit, Elmlohe (DE); Carsten Rogge, Bremerhaven (DE)

(73) Assignee: BLG LOGISTICS SOLUTIONS GMBH & CO. KG, Bremen (DE)

( * ) Notice: Subject to any disclaimer, the term of this patent is extended or adjusted under 35 U.S.C. 154(b) by 64 days.

(21) Appl. No.: 14/304,823

(22) Filed: Jun. 13, 2014

(65) Prior Publication Data

US 2014/0345209 A1 Nov. 27, 2014

Related U.S. Application Data

(63) Continuation-in-part of application No. PCT/EP2012/075666, filed on Dec. 14, 2012.

(30) Foreign Application Priority Data

Dec. 16, 2011 (DE) ..... 10 2011 088 921

(51) Int. Cl.
*E02D 27/52* (2006.01)
*E04H 9/16* (2006.01)

(52) U.S. Cl.
CPC . *E02D 27/52* (2013.01); *E04H 9/16* (2013.01)

(58) Field of Classification Search
CPC ..... E02D 27/52; E04H 9/16
USPC ..... 52/167.5, 710, 708, 745.05; 405/230, 405/250, 251, 252; 248/678, 677, 679
See application file for complete search history.

(56) References Cited

U.S. PATENT DOCUMENTS

| | | | | |
|---|---|---|---|---|
| 3,239,990 | A * | 3/1966 | Adler | 52/745.04 |
| 3,828,513 | A * | 8/1974 | Vanderklaauw | 52/745.04 |
| 3,893,304 | A * | 7/1975 | Pochitaloff-Huvale et al. | 405/136 |
| 4,111,450 | A * | 9/1978 | Pinto | 280/407.1 |
| 4,290,716 | A * | 9/1981 | Lamy | 405/203 |
| 4,700,923 | A * | 10/1987 | Lewis et al. | 248/679 |
| 6,164,615 | A * | 12/2000 | Basham | 248/678 |
| 6,385,917 | B1 * | 5/2002 | Konomoto | 52/167.6 |
| 7,409,799 | B2 * | 8/2008 | Tsai | 52/167.6 |
| 7,707,797 | B2 * | 5/2010 | Henderson | 52/745.17 |
| 8,973,887 | B2 * | 3/2015 | Nakata | 248/636 |
| 9,080,305 | B2 * | 7/2015 | Vandenbulcke et al. | |

(Continued)

FOREIGN PATENT DOCUMENTS

| | | |
|---|---|---|
| DE | 20 2008 001 465 U1 | 4/2008 |
| DE | 20 2010 015 762 U1 | 1/2011 |
| EP | 2 036 815 A1 | 3/2009 |

*Primary Examiner* — Brent W Herring
(74) *Attorney, Agent, or Firm* — Seed Intellectual Property Law Group PLLC

(57) ABSTRACT

The invention concerns a support for offshore foundation structures, in particular for tripods, having a bearing surface for receiving gravitational force, a base surface for applying gravitational force to the ground, and a supporting structure for the transfer of force from the bearing surface to the base surface. The invention concerns in particular such a support having two separate frame elements which respectively have a bearing sub-surface and a base sub-surface, as well as a bridge member which can be coupled to the frame elements in the region of the bearing sub-surfaces for the transfer of force between the frame elements in a substantially horizontal direction.

15 Claims, 10 Drawing Sheets

(56) References Cited

U.S. PATENT DOCUMENTS

| | | | | |
|---|---|---|---|---|
| 2007/0107366 | A1* | 5/2007 | Franco | 52/726.4 |
| 2008/0247827 | A1* | 10/2008 | Altman et al. | 405/197 |
| 2011/0061321 | A1* | 3/2011 | Phuly | 52/297 |
| 2011/0170956 | A1* | 7/2011 | Vandenbulcke et al. | 405/227 |
| 2012/0027524 | A1* | 2/2012 | Gehring | 405/195.1 |
| 2012/0137620 | A1* | 6/2012 | Gevers et al. | 52/651.01 |
| 2012/0213594 | A1* | 8/2012 | Vandenbulcke et al. | 405/228 |
| 2012/0272614 | A1* | 11/2012 | Perner et al. | 52/745.17 |
| 2013/0272796 | A1* | 10/2013 | Horton, III | 405/204 |
| 2014/0290161 | A1* | 10/2014 | Zavitz | 52/223.14 |
| 2014/0341656 | A1* | 11/2014 | Lawson | 405/195.1 |

* cited by examiner

SUPPORT FOR OFFSHORE FOUNDATION STRUCTURES, PARTICULARLY TRIPODS

BACKGROUND

1. Technical Field

The present invention concerns a support for offshore foundation structures, in particular for tripods, having a bearing surface for receiving gravitational force, a base surface for applying gravitational force to the ground, and a supporting structure for the transfer of force from the bearing surface to the base surface.

2. Description of the Related Art

The storage of offshore foundation structures is assuming an increasingly greater significance by virtue of the expanding market segment in storage areas near the coast or on port and dockyard sites. The foundation structures of contemporary offshore wind power installations are of considerable dimensions, they are generally over 50 meters in height and—in the case of tripods—generally involve an inherent weight of several hundreds of tons. To be able to satisfy the rising demand for foundation structures for offshore wind power installations such foundation structures are produced with increasing capacity in the manufacturing installations. To be able to bridge over the time between production of the foundation structures and installation thereof at the erection location, storage of the foundation structures on the site of the manufacturer and/or at one or more further storage locations, for example on a dockyard or port site, is necessary. Because of the extremely high gravitational forces which the foundation structures exert on the ground therebeneath storage by means of suitable supports is of substantial importance. Supports necessarily have to be selected, which on the one hand have adequate structural integrity to be able to carry a gravitational force of several hundreds of tons, while on the other hand they have a sufficiently large base surface to be able to apply the received gravitational forces to the ground in such a way that the latter is not damaged and/or subsides.

Hitherto generally available heavy-load supports have been used for the storage of foundation structures, in particular tripod structures, which are not explicitly adapted for use for the storage of such structures. Such supports are comparatively large because they are designed for an unspecified load situation. In addition, in the storage of foundation structures for offshore wind power installations, in particular tripod structures, there is the problem that the placement location during storage and before loading the structures on to a ship for moving them to an erection location can necessitate re-positioning the structures one or more times to take account of logistical demands in the region of the storage locations, for example in dockyard or port areas. In that respect the known supports are only to be re-positioned with the involvement of a high level of logistical and technical complication and expenditure and also frequently require special preparation of the underlying ground on which they are set down. The use of known supports on soft grounds which are not especially consolidated is not readily possible.

BRIEF SUMMARY

One or more embodiments of the present invention is to provide a support which permits improved handling when setting up the foundation structures and in particular upon re-positioning of the foundation structures. In particular the object was also to provide a support which is of the lowest possible inherent weight, having regard to the loads to be carried.

In one embodiment the support has two separate frame elements which respectively have a bearing sub-surface and a base sub-surface, as well as a bridge member which can be coupled to the frame elements in the region of the bearing sub-surfaces for the transfer of force between the frame elements in a substantially horizontal direction. The bridge member is also referred to by the man skilled in the art as the sleeper frame. In that respect an embodiment of the invention makes use of the realization that handling in terms of positioning of the supports is considerably simplified by the supports themselves being of a modular structure. The modular structure comprises two frame elements and a bridge member connecting the frame elements in the coupled condition permits transportation of the foundation structure together with bridge member by means of a lifting and/or transporting device like for example a heavy-load vehicle (or a plurality of heavy-load vehicles when the foundation structure has a plurality of support feet) to a placement location wherein at the placement location either the separate frame elements are subsequently positioned relative to the bridge member and are coupled thereto or optionally the frame elements are already disposed at the placement location and the bridge member is respectively positioned relative to them and is coupled to them. The bridge member is arranged in such a way that it can be arranged substantially horizontally between the frame elements and in the uncoupled condition can be removed to the side. By virtue of the horizontal orientation the bridge member is also permitted by the vehicle by an approach from below between the frame elements.

Preferably the bridge member also has a bearing sub-surface for receiving gravitational force and is adapted for applying the gravitational force received thereby to the frame elements in the substantially horizontal direction. By virtue of its central arrangement the bridge member is adapted to carry a large part of the entire gravitational force. That proportion becomes increasingly greater, the greater the extent to which the bearing sub-surface of the bridge member is acted upon with force, in relation to the bearing sub-surfaces of the frame elements. One advantage is in particular also that distribution of force is promoted by means of the bridge member in the horizontal direction and consequently that entails better distribution of force.

A further advantageous development thereof provides that in the condition of being coupled to the bridge member the frame elements are spaced so far from each other that the line of gravity of the force received by the support extends outside the base sub-surfaces, in particular between the base sub-surfaces. That provides that the application of force is concentrated on the boundary region of the respective base sub-surfaces—said boundary region being the inner region relative to the line of gravity of the force carried by the support. In that respect the reference to the inner boundary region is used to mean the respective part of the base sub-surface, that is towards the oppositely disposed frame element. In principle that uneven loading of the base sub-surfaces means that the ground beneath the base sub-surfaces, in the inwardly disposed region of the surface covered by the support, is loaded more greatly than further outwardly disposed regions. Because of the inevitably yielding nature of the ground region the frame elements have a tendency to move away from each other outwardly at the bottom. Because however the bridge member which is coupled to the frame elements in the region of the bearing sub-surfaces, that is to say in the upper part thereof, carries a large part of the gravitational force by way of its bearing sub-surface and applies that to the frame elements in a substantially horizontal direction the frame elements are in turn acted upon with force at the outside thereof and the support is stabilized, insofar as the frame elements are prevented from moving away from each other as a reaction to the applied gravitational force. It has been found that this way of stabilizing the support in relation to the considerable magnitude of the gravitational force to be carried has extreme weight-saving consequences.

The above-discussed effect of stabilizing the frame elements by means of the horizontally arranged bridge member is also achieved and/or promoted by the fact that the centroids of the bearing sub-surfaces of the frame elements are displaced relative to the centroids of the base sub-surfaces in the direction of the line of gravity of the force received by the support. Upon proper appropriate positioning of the foundation structure or a support leg of a foundation structure (for example a tripod) relative to the frame elements the line of gravity of the gravitational force which is overall carried by the support extends substantially through a point which is disposed centrally between the two supports. The respective centroids of the bearing sub-surfaces or the centroid normals of those bearing sub-surfaces are therefore displaced inwardly in relation to the centroids or centroid normals of the respective base sub-surfaces of the frame elements. Because therefore the surface which is occupied by the respective frame elements acts further inwardly than the centroid of the base sub-surface in relation to the center of the support when viewed in the usual conventional manner would require, a moment is produced, which acts in such a way that the frame elements tend to tilt in the direction of the line of gravity of the force carried by the support. That in turn produces a pressure force on the bridge member, which then supports the frame elements relative to each other and stabilizes the support.

An advantageous development of the invention provides that arranged on the frame elements are respective beams which can be coupled to the bridge member on the one hand and to a ground plate having the base sub-surface on the other hand. In that way it is possible for the pressure force carried by the bridge member in the horizontal direction to be applied directly to the ground plate and thus the base sub-surface of the frame elements. The bridge member is supported not only in the proximity of the bearing sub-surfaces but also in the region near the ground of the support, and that leads to a significant increase in stability.

Preferably the beams can be respectively coupled to the ground plate in a region which is displaced relative to the respective centroid or centroid normal of the base sub-surface in opposite relationship to the direction of the line of gravity of the force received by the support. In other words the beams are supported further outwardly in the region of the ground plate relative to the centroid of the base sub-surface. That provides that the force applied to the support or the frame elements is better distributed to the entire base sub-surface. That in turn permits the bridge member and the beams to be of a design configuration which saves on material and weight. The greater the force carried away by way of the bridge member and the beams in the direction of the ground plate, the correspondingly more economical in terms of weight can the design of the supporting structure of the frame elements be.

In an advantageous development of the invention the frame elements respectively have a supporting structure with a first and a second wall extending vertically upwardly from the ground plate, wherein the first and second walls cross and their end faces remote from the ground plate have the bearing sub-surfaces. Because the first and second walls of the frame elements are respectively arranged in mutually crossing relationship, the two walls are mutually supported in relation to buckling moments which occur. A very high level of rigidity is achieved by means of the crossed geometry, in relation to the material cross-section.

In a further advantageous configuration of the support the first wall has outside the bearing sub-surface at both sides an opening through which a respective beam extends. That gives the advantage that the beam does not have to be respectively passed around the first wall, which would result in reductions in stability, at any event weight-specific stability reductions.

The opening for the respective beams is preferably open upwardly. In that way the beams can also be quickly replaced if required if wear phenomena or damage occurs.

Further preferably the support and in particular at least one of the frame elements has one or more positioning pins for determining the position of the frame elements. The one or more positioning elements facilitate orientation of two frame elements relative to each other and/or orientation of a support in relation to an adjacent support and/or make it easier to ascertain the position of the supports relative to a foundation structure to be supported thereon. In the simplest case the positioning pins can be in the form of vertically upwardly extending cylindrical pins or optionally in further advantageous embodiments can involve a or a respective optical reference geometry which can be detected by means of electronic data processing, in particular image processing of cameras and control or positioning systems.

In the case of a support in accordance with a further preferred embodiment of the invention the bridge member has two or more plug-in connectors which are adapted for preferably positively lockingly coupling the bridge member to sockets of a corresponding configuration on a vehicle, preferably on the load surface of a heavy-load transporter, particularly preferably a module transporter. The bridge member is secured on the load surface of the vehicle by means of that coupling arrangement in such a way that it rests completely thereon in order to be able to distribute the gravitational force loading it to a surface area which is as large as possible. Here for example a so-called SPMT (self-propelled modular transporter) is considered as the preferred vehicle, as is to be obtained inter alia from the corporation Scheuerle. Further preferably two or more plug-in connectors are arranged on opposite sides of the bridge member and are spaced relative to each other in such a way that the bridge member is secured by way of corresponding sockets on the vehicle. The spacing of the adjacently arranged plug-in connectors depends on the structure of the load surface or the chassis frame structure of the designated vehicle and is advantageously adapted thereto. In accordance with a further preferred embodiment plug-in connectors are provided at mutually differing spacings on the bridge member in order alternatively to ensure use of the bridge member on the load surface of different vehicles.

Preferably in a support in a further embodiment the bridge member can be coupled by way of the beams to the frame elements, preferably by means of one or more screw connections. By virtue of coupling by way of the beams in the region of the bearing sub-surfaces—that is to say upwardly—the space beneath the bridge member is not required for further support and stabilization purposes and remains free so that for example a module transporter can be easily moved under the support in order to lift and move the entire support structure together with foundation structure. A change in the storage location of the support together with foundation structure is thus markedly simplified in comparison with known systems.

Preferably the frame elements of the support respectively have at their ground plate receiving means for forklift truck forks and in addition in the region of the receiving means wear protection rails are let into the ground plate. That increases the longevity of the frame elements and the support overall considerably in those situations of use where frequent transport of the supports and individual frame elements is required.

In a further aspect one embodiment provides that it has an adaptor plate which lies on the bridge member and/or the receiving surface of the support and which is held captively on the support in the horizontal plane by means of stiffening and positioning means provided at the underside on the adaptor plate. The adaptor plate is preferably positioned captively relative to the support by means of the stiffening and positioning means in two axes in a horizontal plane when it is resting on the support. Further preferably the adaptor plate can be coupled to one or both halves of the support by means of reversibly releasable fixing means, preferably screw connections. The adaptor plate is preferably adapted to apply forces to the support which are applied by way of a smaller surface area than the spacing of the receiving surfaces of the support halves of the support would otherwise permit. Accordingly the provision of an adaptor plate represents a system expansion of an embodiment of the invention.

Preferably the underside stiffening and positioning means are adapted to embrace at least one of the vertically upwardly extending walls, preferably in a U-shape.

Further preferably the adaptor plate has stiffening means at its underside. The stiffening means are preferably in the form of longitudinal ribs. The longitudinal ribs preferably extend parallel to the beams of the frame elements when the adaptor plate is appropriately fitted in place.

Preferably the supporting means have one or more openings for being brought into engagement with coupling means. The coupling means are preferably adapted to connect the adaptor plate to a supporting contact body which permits the transmission of force from the adaptor plate to a vehicle to be connected to the support and/or the adaptor plate. The supporting contact body is preferably of a T-shaped cross-section and extends between two adjacent longitudinal ribs. By virtue of the part of the supporting contact body, that is perpendicular to the region extending between the longitudinal ribs, this arrangement entails the function of ensuring a support surface area which is as large as possible for application of the forces from the adaptor plate to the subjacent vehicle or ground.

The stiffening and positioning means of the adaptor plate preferably have one or more portions which in the mounted condition are oriented in parallel and closely spaced relationship with the vertically extending walls to limit or prevent pivotal movement or tilting of the adaptor plate about a vertical axis.

The invention further concerns a vehicle, in particular a heavy-load transporter, for transporting a support or for transporting an offshore foundation structure with support, having a plurality of axles and a load surface. In the case of such a vehicle improved handling of supports of the kind set forth in the opening part of this specification is attained in that the vehicle has two or more sockets for positively lockingly coupling the vehicle to plug-in connectors of corresponding configuration of the bridge member of a support according to one of the above-described preferred embodiments. In that case the sockets are preferably mounted laterally to a frame structure of the vehicle to leave the load surface as unimpaired as possible so that the gravitational force applied can be distributed to as many axles of the vehicle as possible. The invention thus also concerns the use of a vehicle of the above-described kind having a load surface and a bridge member coupled to the load surface for transporting a support according to one of the above-described embodiments of the invention or for transporting an offshore foundation structure together with such a support, or for transporting an offshore foundation structure together with the bridge member but without the frame elements of the support.

The invention also concerns a method of transporting and storing tripod foundation structures, in particular a port-to-port transport method. In one embodiment improved handling of supports of the kind set forth in the opening part of this specification, by the method including the steps: providing the tripod structure on six first frame elements, providing three vehicles according to one of the above-described preferred embodiments to which a respective bridge member of a support according to one of the above-described preferred embodiments is coupled, positioning the vehicles between the frame elements in such a way that the respective bridge member is arranged centrally under a base surface of the tripod, lifting the tripod structure, preferably by means of the vehicles, moving the tripod structure by means of the vehicles to a (second) set-down location at which six second frame elements are provided and are positioned for receiving the tripod structure, wherein the second frame elements are respectively associated with supports according to one of the above-described preferred embodiments, positioning the vehicles between the second frame elements in such a way that the bridge members can be coupled to the second frame elements, lowering the tripod structure, preferably to the height of the second frame elements, coupling the bridge members to the second frame elements, and preferably completely lowering the tripod structure so that the gravitational force thereof is received by the prepared supports. Preferably the first frame elements are also respectively associated with supports according to one of the above-described preferred embodiments of the invention. Particularly preferably the above-discussed SPMTs are considered as the vehicles, as they are remotely controllable and in particular remotely controllable in synchronized relationship.

An advantageous development of the method provides one, more or all of the steps: providing a tripod structure, providing a preferably floating transport platform at a first location, providing three first supports on the transport platform, moving the tripod structure on to the transport platform, setting down the tripod structure on the three first supports, moving the first transport platform from the first location to a second location, lifting the tripod structure from the three first supports, moving the tripod structure from the transport platform to a (first) set-down location, the ground region of which is designed to receive heavy loads, and setting down the tripod structure on the six first frame elements or on three supports according to one of the above-described preferred embodiments of the invention. The above-described embodiments of the method provide for logistical handling of foundation structures, in particular tripod structures from the place of manufacture to the storage location by way of one or more stations using the supports and adapted vehicles. A particular advantage of the method is in particular the suitability of thereby being able to set down foundation structures on ground surfaces which cannot be achieved with conventionally known heavy-load transport systems which are primarily designed on a rail basis, or which are not specifically designed for carrying high gravitational forces by means of supports of conventional structure.

BRIEF DESCRIPTION OF THE SEVERAL VIEWS OF THE DRAWINGS

The invention is described in greater detail hereinafter by means of a preferred embodiment and with reference to the accompanying Figures in which.

DETAILED DESCRIPTION

Insofar as structurally and/or functionally similar or identical components are shown in the different Figures, identical references are allocated thereto. In regard to the descriptive parts relating to those references, in the absence of explicit mention in respect of each Figure attention is expressly directed in that respect to the descriptive parts relating to the other Figures.

Figure 1:
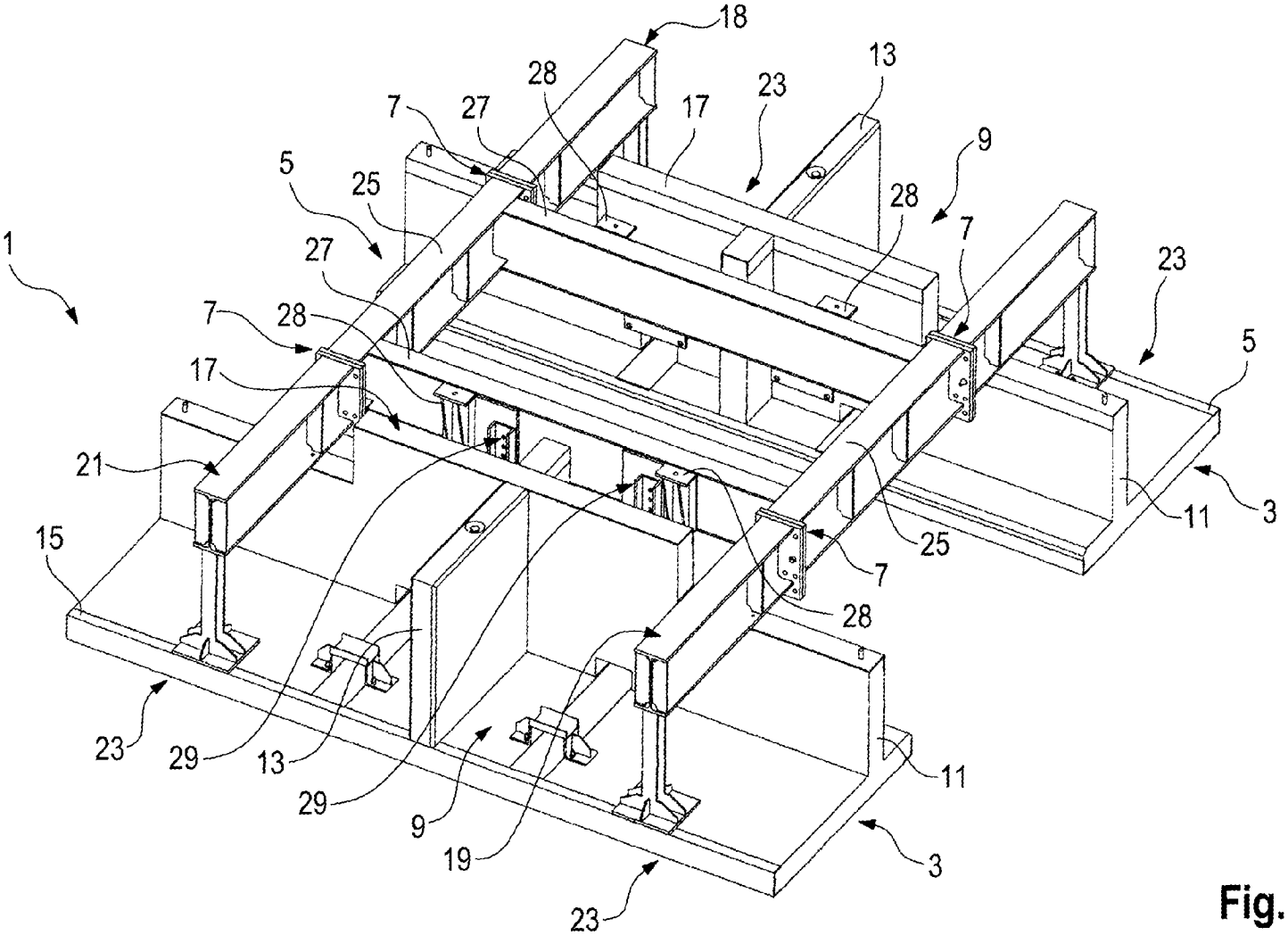
FIG. 1 shows a three-dimensional view of a support according to one embodiment of the present invention.

FIG. 1 shows a support 1 according to one embodiment of the present invention. The support 1 has two frame elements 3. The frame elements 3 are coupled together by means of a bridge member 5. The bridge member 5 is arranged substantially horizontally between the two frame elements 3 and is respectively coupled to the frame elements 3 in connecting regions 7. Each frame element 3 has a supporting structure 9 having a first wall 11 and a second wall 13. The first wall 11 and the second wall 13 are respectively arranged in mutually crossing relationship and mutually support each other. Each of the frame elements further has a ground plate 15. At their end remote from the ground plate 15 the supporting structures 9 of the frame elements 3 have bearing sub-surfaces 17 (see in that respect also FIG. 6). Provided on both sides of the bearing sub-surfaces on the frame elements 3 there are respectively a first beam 19 and a second beam 21 which are respectively coupled to the ground plate 15 in a region 23 near the ground. The bridge member 5 has two compression struts 25 which in the illustrated position are oriented in alignment with the beams 19, 21 and two transverse struts 21 extending orthogonally relative to the compression struts 25 and from one compression strut 25 to the opposite compression strut 25. Mounted to the transverse struts 27 are two respective plug-in connectors 29 adapted for preferably positively locking coupling to sockets of corresponding configuration on a load surface of a vehicle. In addition two profile lugs 28 are provided on the transverse struts 27. The profile lugs 28 are optionally adapted for fixing to a foot plate, a so-called mud plate, of a support leg of a foundation structure. The so-called mud plate generally does not serve to apply the entire gravitational force but rather functions as a cover means and a lateral support.

Figure 2:
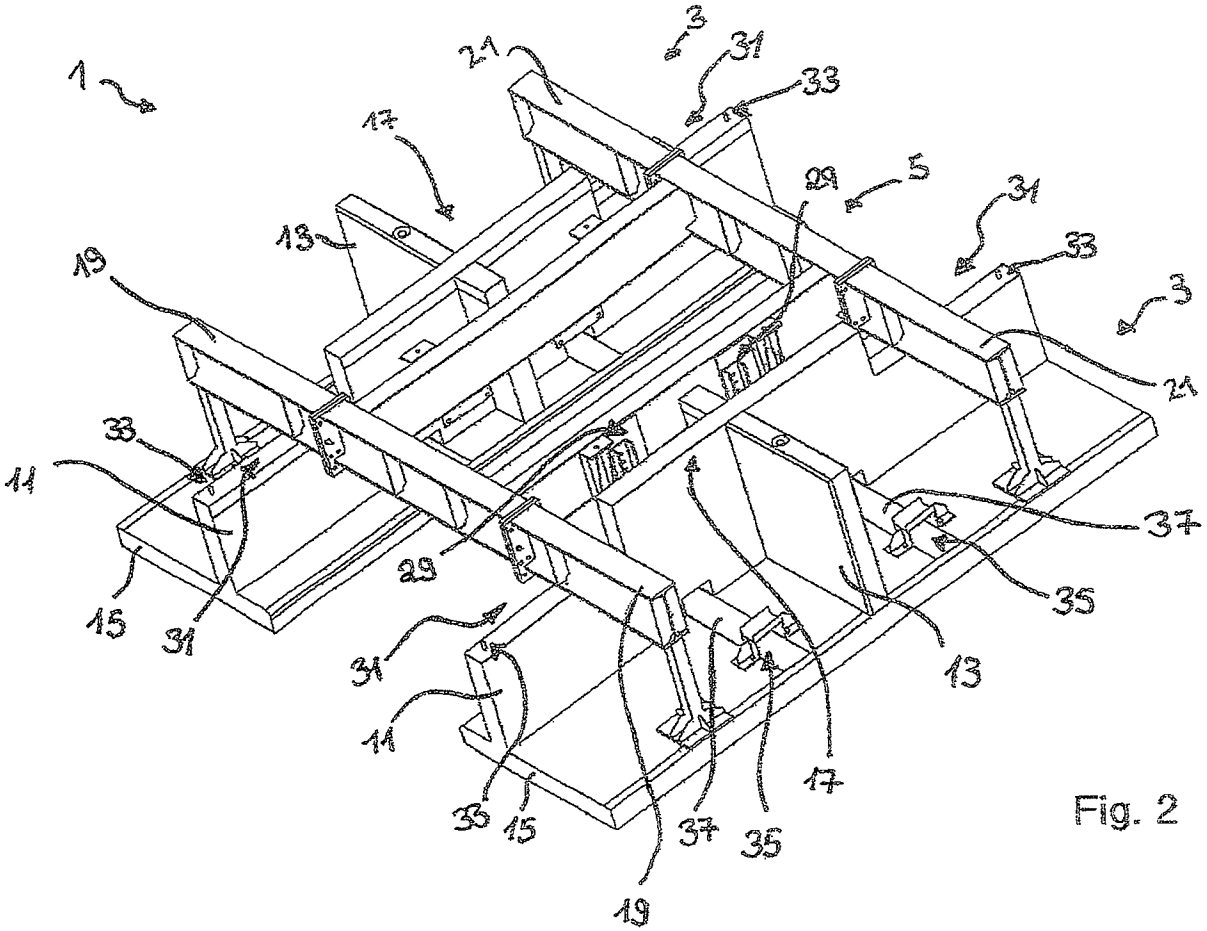
FIG. 2 shows an alternative three-dimensional view of the support from FIG. 1.

The view in FIG. 2 shows substantially the same structural elements as FIG. 1. In addition attention is directed to the following:

The first wall 11 of a respective frame element 3 has openings 31 on both sides of the region of the bearing sub-surface 17. A respective one of the beams 19, 21 extends through the openings 31.

In addition in the present embodiment the frame elements 3 have a respective positioning element 33 in the region of the openings 31. The positioning element 33 is in the form of a respective pin-shaped element. The frame elements 3 also have two forklift truck fork receiving means 35, such as brackets as shown in FIG. 2, on the ground plate 15. Openings are optionally provided in the first wall in aligned relationship with the receiving means 35, through which openings the tips of the forklift truck fork can extend. Wear prevention rails 37 are additionally fitted in place in the region of the receiving means 35.

Figure 3:
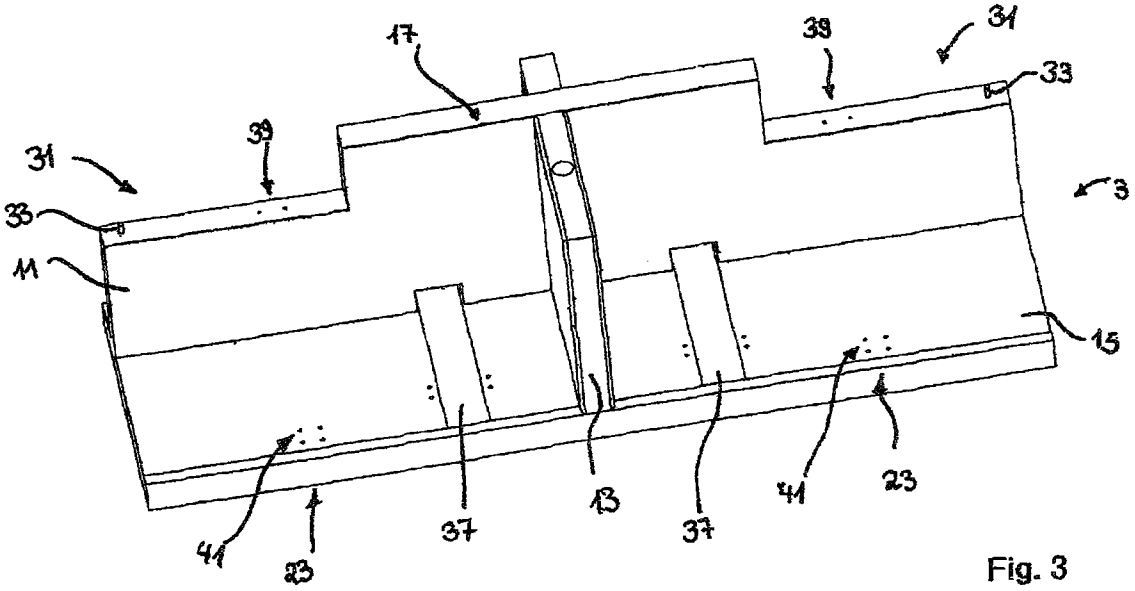
FIG. 3 shows a three-dimensional view of a frame element for a support as shown in FIGS. 1 and 2, without beam.
Figure 4:
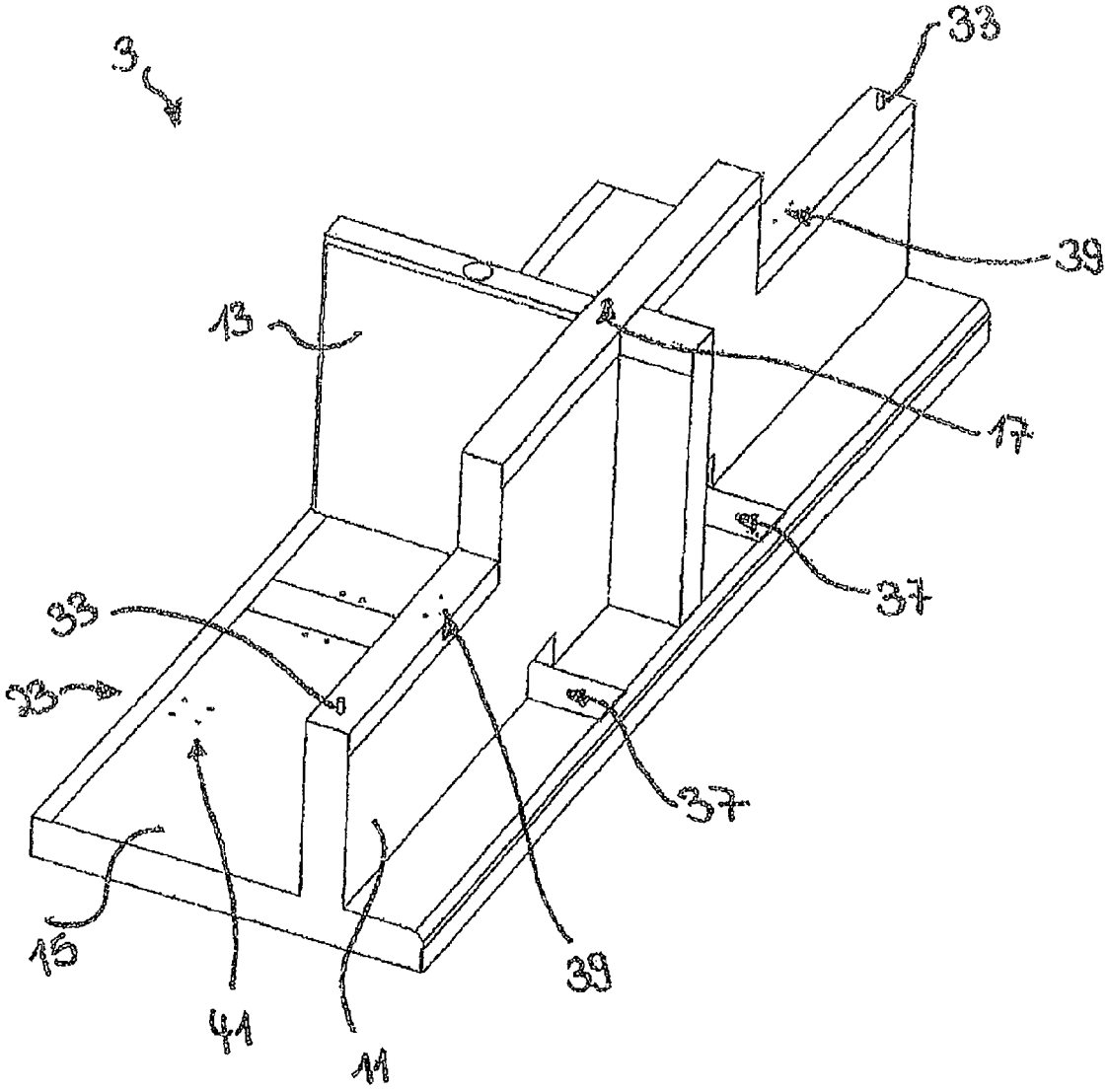
FIG. 4 shows an alternative view of the frame element of FIG. 3.

FIGS. 3 and 4 each show a frame element 3 from a different viewing angle and with attachment components removed. Thus, in the region of the openings 31 and in the connecting region 23 of the ground plate, for example drill hole patterns for receiving fixing means, in particular fixing screws, are shown, indicated by references 39, 41. Those drill hole patterns 39, 41 serve for fixing the beams (see FIGS. 1, 2 and 5) to the frame elements 3.

Figure 5:
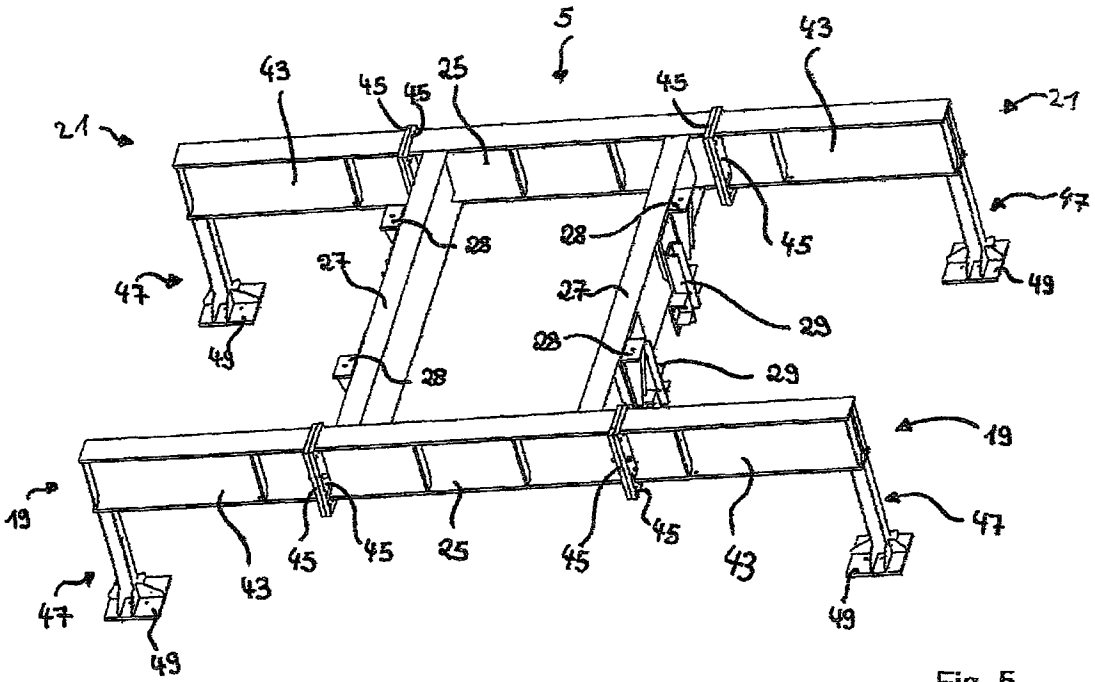
FIG. 5 shows a three-dimensional view of a bridge member together with beams for a support as shown in FIGS. 1 through 4.

FIG. 5 shows the construction of the connection consisting of the bridge member 5 and the beam 19. Each of the beams 19 has a support or pressure beam member 43 which in the illustrated position is oriented in aligned relationship with the compression struts 25 of the bridge member 5. Both the compression strut 25 and also the support or pressure beam member 43 of the beams 19, 21 have at mutually facing end faces connecting plates 45 which can be coupled together by passing screw connections therethrough.

Provided at an end of the support or pressure beam members 43 of the beams 19, 21, that is remote from the connecting plates 45, are respective support legs 47 which can be arranged by way of suitable foot plates 49 in the connecting regions 23 on the ground plate 15 of the frame elements 3 (see FIGS. 1 through 4) and can be coupled to them. The connection of the support legs 47 by way of the foot plates 49 to the ground plate 15 is preferably designed for a tensile loading.

Figure 6:
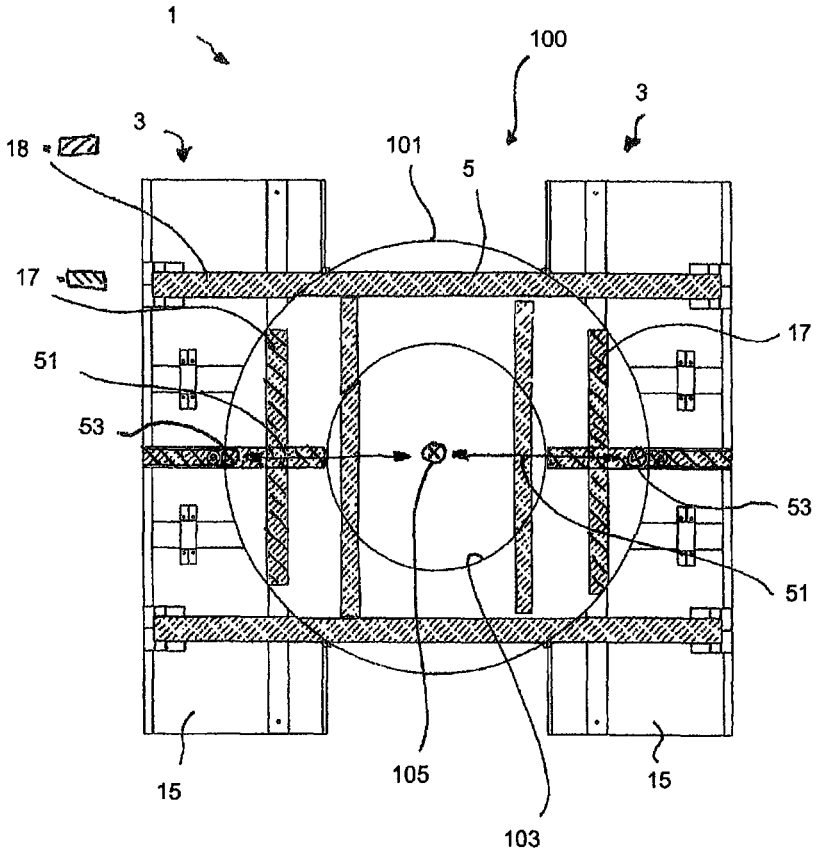
FIG. 6 shows a diagrammatic plan view of a support as shown in the Figures with foundation structure positioned thereon.

FIG. 6 shows a diagrammatic plan view of a support 1 in the mounted condition. A bridge member is arranged between the frame elements 3 and coupled to the frame elements 3. Arranged on the support 1 is the foot of a foundation structure 100. The foundation structure 100 has a base surface which for example can lie in a region between an outer peripheral line 101 and an inner peripheral line 103.

It can be seen in particular from FIG. 6 that a line of gravity 105 of the gravitational force applied overall to the support 1 extends substantially centrally between the two frame elements 3. The bearing sub-surfaces 17 of the frame elements 3 have a centroid normal 51. The position of the centroid normal 51 is dependent on the base surface which is acted upon by the structure 100. The base surfaces which are identical to the base surfaces of the ground plates 15 each have a respective centroid normal 53.

The centroid normal 51 of the bearing sub-surfaces 17 is displaced 'inwardly' relative to the centroid normal 53 of the base sub-surfaces of the frame elements 3 in the direction of the line of gravity 105 of the force applied to the support 1 in a region symbolically indicated by the arrows identified by reference 51, thereby achieving the force distribution and stabilization effects described hereinbefore in the description. The smaller the base surface is, the correspondingly further is the centroid normal 51 displaced in the direction of the line of gravity 105. In a similar fashion a correspondingly greater proportion of the overall gravitational force is applied to the bridge member 5. In turn, the greater the amount to which the bearing sub-surfaces 17 (hatched towards the left) of the frame elements 3 are subjected to force, the correspondingly further is the centroid normal 51 displaced in opposite relationship to the direction of the line of gravity 105.

Figure 7:
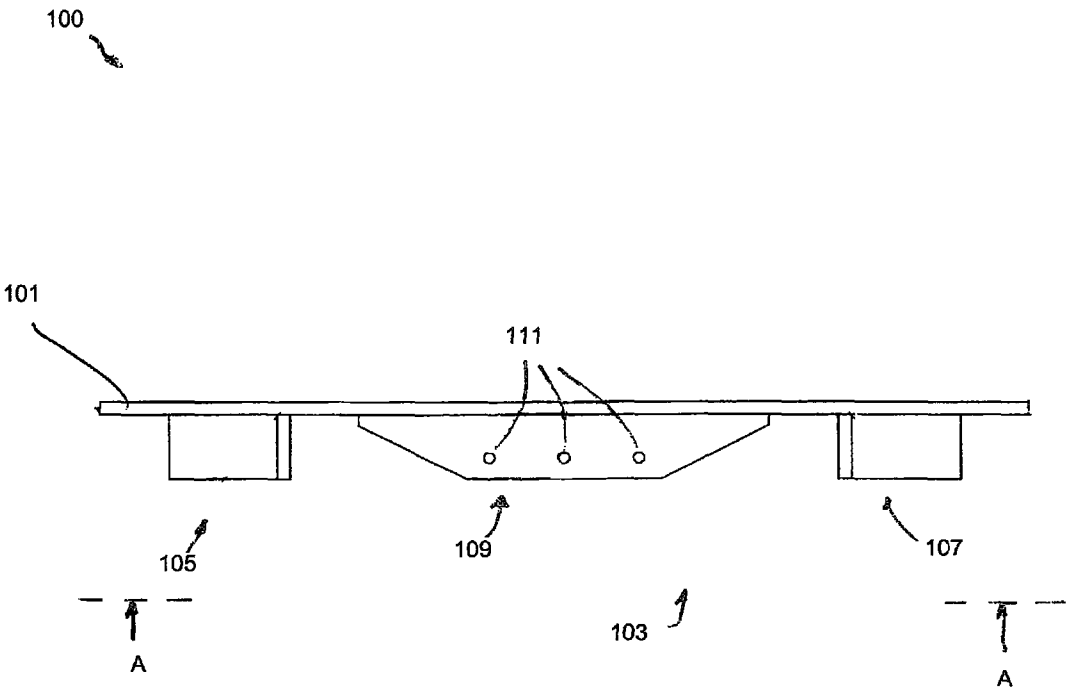
FIG. 7 shows a side view of an adaptor plate for use with the support according to one embodiment of the invention.

FIG. 7 shows an adaptor plate for use with the support 1 according to one embodiment of the invention (FIGS. 1 through 6). The adaptor plate 100 has a cover plate 101. First and second stiffeners, such as stiffening and positioning means 105, 107, are provided at the side 103 of the adaptor plate 100, that is the lower side in FIG. 7 and also in the correct position of use. Also provided on the underside 103 of the cover plate 101 between the stiffening and positioning means 105, 107 are supporting means in the form of longitudinal ribs 109. Both the stiffening and positioning means 105, 107 and also the supporting means 109 are fixedly connected to the underside 103 of the cover plate 101, preferably by means of welding, particularly preferably in the form of a full-depth join.

Along their side surfaces the supporting means have a plurality of openings 111. The openings 111 are adapted to be brought into engagement with coupling means, for example bolts or screws, so that a supporting contact body can be coupled thereto between the support means 109. The supporting contact body (not shown) is preferably adapted to distribute gravitational forces acting on the adaptor plate 100 from above over a contact bearing surface which is as large as possible, which for example makes it easier to set up the adaptor plate on the ground or on a vehicle.

Figure 8:
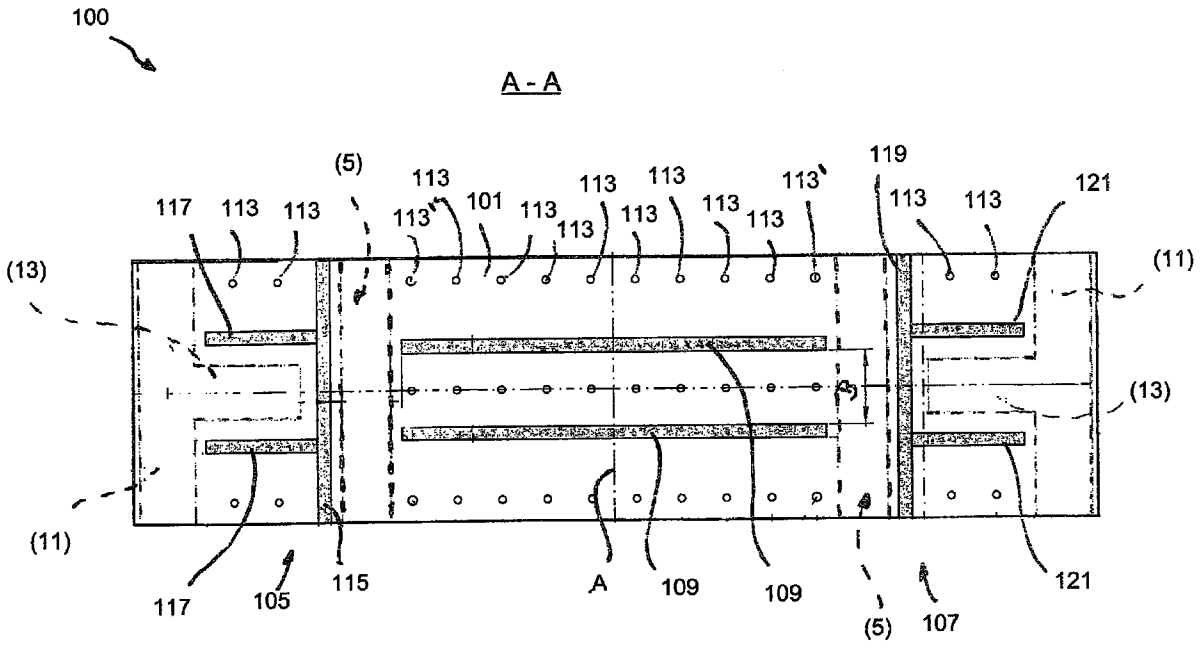
FIG. 8 shows a further side view of the underside of the adaptor plate of FIG. 7.

FIG. 8 shows a side view on to the underside 103 of the adaptor plate 100. Let into the cover plate 1 are a plurality of openings 113 which extend completely through the cover plate 101. Reference 113' denotes respective threaded bores adapted to receive clamping jaws. For reasons of clarity of the drawing only the openings on one side of the cover plate 108 are referenced. The openings 113 can be used in multi-functional fashion, for example for mounting retaining or fixing means.

The stiffening and positioning means 105 at the left in FIG. 8 have a first limb 115 extending in the transverse direction of the adaptor plate and two limbs 117 extending in the longitudinal direction of the adaptor plate 100. The limbs 115, 117 are adapted to embrace at least one portion of the vertical wall 13 (indicated by broken lines) on the outside of the adaptor plate 100, viewed from the limbs, and they extend in the direction of the vertical wall 11 extending orthogonally thereto (also indicated by broken lines). In that way, besides positioning of the adaptor plate 100 relative to the left-hand support half, this arrangement ensures in particular stiffening of the adaptor plate, which also applies to the right-hand stiffening and positioning means 107. The limb 115 extending in the transverse direction is spaced from the supporting means 109 which are positioned centrally on the adaptor plate 100 and which are in the form of longitudinal ribs, to such a degree that one of the transverse struts of the bridge member 5 can extend through therebetween (this is also indicated by broken lines). The stiffening and positioning means 107 are of a mirror-symmetrical configuration relative to a central axis A, on the side of the adaptor plate 100 which is at the right in FIG. 8. The stiffening and positioning means 107 have a limb 119 extending in the transverse direction and two limbs 121 extending in the longitudinal direction. The transversely and longitudinally extending limbs perform the same functions as the limbs of the stiffening and positioning means 105 in relation to the vertical walls 11, 13 of the right-hand support half. By virtue of the symmetrical configuration a part of the bridge member 5 also extends between the supporting means 109 and the second stiffening and positioning means 107, more precisely between the right-hand transversely extending strut 119.

Figure 9:
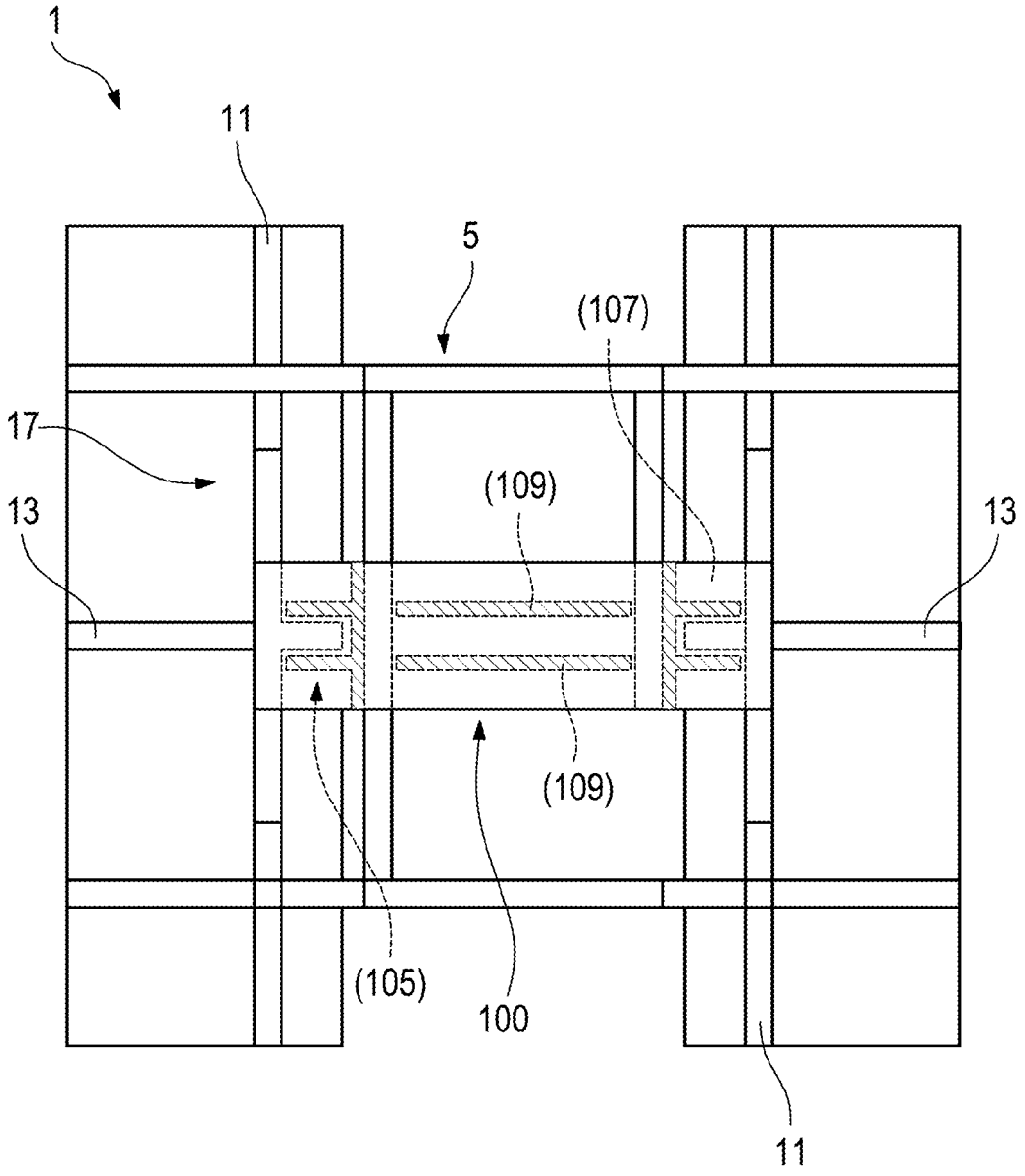
FIG. 9 shows a side view of the plan view of the support according to one embodiment of the invention with the adaptor plate from FIGS. 7 and 8.

By virtue of the arrangement of the positioning elements, the adaptor plate in the mounted condition is held in substantially the correct position centrally on the support 1 (see also FIG. 9). The two longitudinal ribs of the supporting means 109 are spaced from each other by a width B and are oriented parallel to each other in the longitudinal direction of the adaptor plate 100. The width B preferably corresponds to the width of a limb of a T-shaped profile which can be connected at the underside to the adaptor plate, as the supporting contact body.

As can be seen from the view in FIG. 9 the adaptor plate 100 is held by means of the stiffening and positioning means 105, 107 substantially centrally on the support 1 so that this makes it possible for forces to be applied to the support 1 by means of the adaptor plate 100 without the entire base surface of the bearing surfaces 17 having to be connected directly to the load body. The adaptor plate 100 functions as an intermediary which transmits the gravitational forces distributed to a smaller region to the halves of the support. For that purpose the adaptor plate 100 rests on the bearing surfaces 17 and/or on the transverse struts of the bridge member 5. Lateral support of the adaptor plate 100 is ensured by way of the stiffening and positioning means in conjunction with the vertically extending walls 11, 13 of the two support halves.

Figure 10:
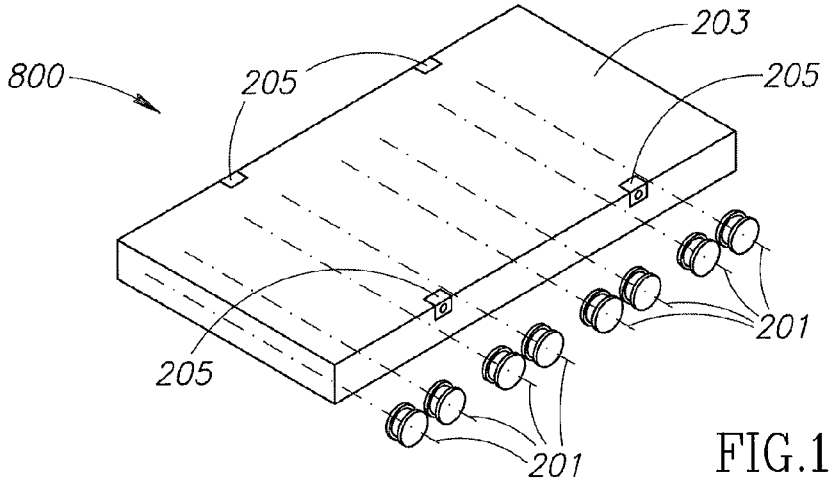
FIG. 10 shows a loading surface of a vehicle.

FIG. 10 shows a schematic illustration of a loading surface 203 of a vehicle 200. The vehicle 200 includes a plurality of axles 201. Along side surfaces of the vehicle there are sockets 205 for coupling with the bridge member 5 of the support 1. In particular, there are plug-in connectors 29 of the transverse struts 27 adapted for lockingly coupling to the sockets 205 of the vehicle 200.

Figure 11:
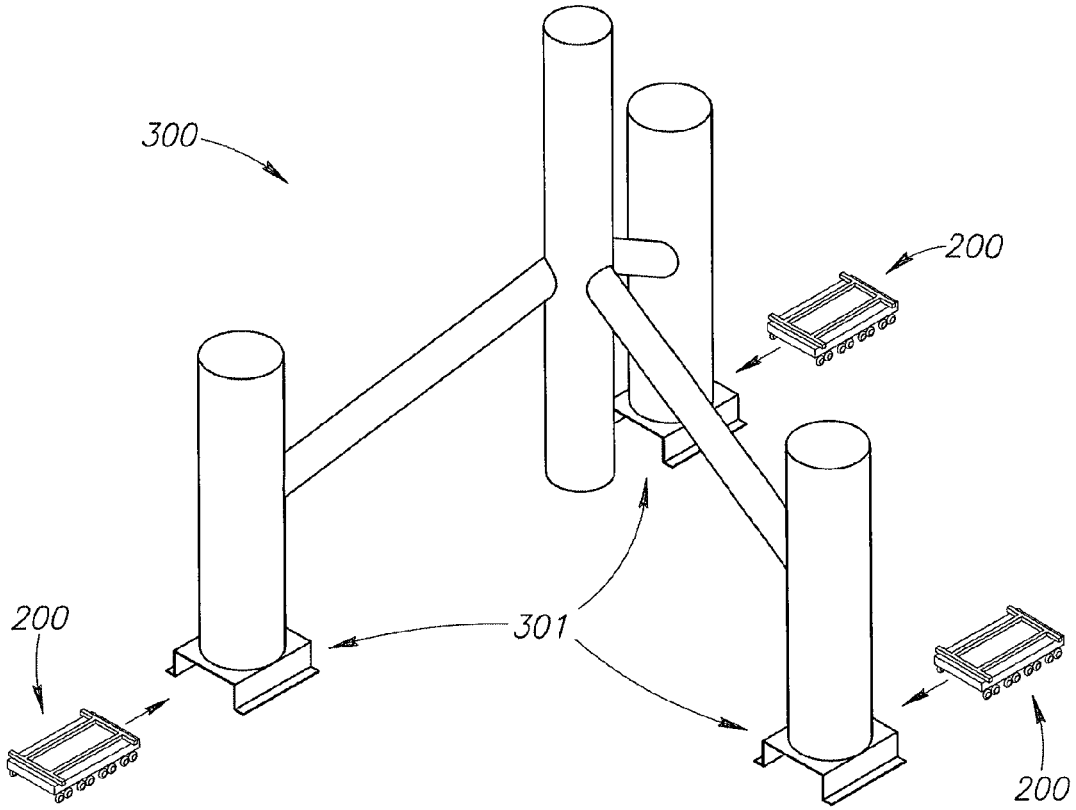
FIG. 11 shows a tripod structure being loaded on the vehicles of 10 using the support of FIG. 1.

FIG. 11 shows a tripod structure being loaded on the vehicles of 10 using the supports of FIGS. 1. In FIG. 11, three separate vehicles 200 have the bridge member 5 attached to the loading surface. A base surface 301 of a tripod structure 300 is coupled to a respective fame element 3. The vehicles 200 are driven under frame elements 3 that are supporting the tripod structures 300. That is, the vehicles with the bridge member 5 are driven under the frame elements 3 so that bridge member is arranged centrally under a base surface of the tripod structure and the frame elements 3. The vehicle may then be raised to lift the tripod structure and support the tripod structure to allow transport of the tripod structure, The various embodiments described above can be combined to provide further embodiments. All of the U.S. patents, U.S. patent application publications, U.S. patent application, foreign patents, foreign patent application and non-patent publications referred to in this specification and/or listed in the Application Data Sheet are incorporated herein by reference, in their entirety. Aspects of the embodiments can be modified, if necessary to employ concepts of the various patents, application and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A support for offshore foundation structures for tripods, the support comprising:

first and second frame elements spaced apart from each other, the frame elements having longitudinal axes and including upper inner support surfaces and base elements that extend outward from the upper inner support surfaces; and a support structure having an upper surface that is coplanar with the upper inner support surfaces of the first and second frame elements that together form a support surface for supporting a structure, the supporting structure including beams having longitudinal axes that are perpendicular to the longitudinal axes of the first and second frame elements, the support structure including a bridge member fixed to the beams and located between the first and second frame elements, the support structure coupled to the base elements of the frame elements outward of the upper inner support surfaces and configured to distribute loads on the support surface to an outer portion of the base elements.

2. The support as set forth in claim 1 wherein the beams are located above the first and second frame elements and have ends that are coupled to outer portions of the base elements of the first and second frame elements and configured to transfer gravitational forces to the first and second frame elements.

3. The support as set forth in claim 1 wherein the first and second frame elements are spaced outwardly from the bridge member so that gravitational forces received by the support structure are transferred outwardly.

4. The support as set forth in claim 1 wherein a centroid of the support structure is offset from the centroids of the first and second frame elements, respectively.

5. The support as set forth in claim 1 wherein the beams having first portion coupled to the bridge member and second portions coupled to outer portions of the base elements of the first and second frame elements.

6. The support as set forth in claim 5 wherein the second portions of the beams are coupled to the base elements of the first and second frame elements in regions that are offset from a centroid of the support structure.

7. The support as set forth in claim 5 wherein first and second the frame elements, respectively, have first and second walls extending vertically upward from the base elements, wherein the first and second walls cross each other and have end faces that face away from the base elements.

8. The support as set forth in claim 7 wherein the first wall has recesses facing outward of the support surface of the support structure, wherein the beams extend through the recesses.

9. The support as set forth in claim 8 wherein the recesses are located on an upper surface of the first wall and open upwardly.

10. The support as set forth in claim 1 wherein at least one of the first and second frame elements has one or more positioning pins for determining a position of the first and second frame elements.

11. The support as set forth in claim 1 wherein the bridge member has two or more plug-in connectors that are adapted for coupling the bridge member to sockets on a load surface of a heavy-load transporter.

12. The support as set forth in claim 1 wherein the bridge member is coupled to the first and second frame elements by the beams and one or more screw connections.

13. The support as set forth in claim 1 wherein each of the first and second frame elements include receiving means for receiving forklift truck forks and wear protection rails located on the ground plate.

14. The support as set forth in claim 1 comprising an adaptor plate that lies on the bridge member and the support surface and is held on the support in the horizontal plane by stiffening and positioning means provided at the underside on the adaptor plate.

15. A system comprising:

a support of claim 1 wherein the bridge member includes plug-in connectors; and a heavy-load transporter having a plurality of axles and a load surface, two or more sockets for coupling the transporter to plug-in connectors of the bridge member.

* * * * *